US011392154B2

(12) United States Patent
Zamarreno Ramos et al.

(10) Patent No.: US 11,392,154 B2
(45) Date of Patent: Jul. 19, 2022

(54) CONTROLLED POWER UP AND POWER DOWN OF MULTI-STAGE LOW DROP-OUT REGULATORS

(71) Applicant: pSemi Corporation, San Diego, CA (US)

(72) Inventors: Carlos Zamarreno Ramos, San Diego, CA (US); Satish Vangara, San Diego, CA (US)

(73) Assignee: pSemi Corporation, San Diego, CA (US)

( * ) Notice: Subject to any disclaimer, the term of this patent is extended or adjusted under 35 U.S.C. 154(b) by 151 days.

(21) Appl. No.: 17/001,507

(22) Filed: Aug. 24, 2020

(65) Prior Publication Data

US 2022/0057822 A1 Feb. 24, 2022

(51) Int. Cl.
*G05F 1/46* (2006.01)

(52) U.S. Cl.
CPC ..... *G05F 1/468* (2013.01); *G05F 1/461* (2013.01)

(58) Field of Classification Search
CPC ..... G05F 1/461; G05F 1/468
See application file for complete search history.

(56) References Cited

U.S. PATENT DOCUMENTS

| | | | | |
|---|---|---|---|---|
| 7,495,422 | B2 * | 2/2009 | Mok | G05F 1/575 323/280 |
| 10,185,338 | B1 * | 1/2019 | Lahiri | H02M 3/1584 |
| 10,627,844 | B1 * | 4/2020 | Ji | H03F 3/45 |
| 2018/0017984 | A1 * | 1/2018 | Mayer | G05F 1/575 |
| 2018/0173258 | A1 * | 6/2018 | Singh | G05F 1/575 |

* cited by examiner

*Primary Examiner* — Kyle J Moody
*Assistant Examiner* — Lakaisha Jackson
(74) *Attorney, Agent, or Firm* — Jaquez Land Greenhaus & McFarland LLP; John Land, Esq.

(57) ABSTRACT

Circuits and methods that provide for fast power up and power down times in a multi-stage LDO regulator. In one embodiment, a multi-stage LDO regulator circuit includes, for each stage for which fast power up and/or power down times are desired, at least one transconductance amplifier coupled and configured to compare a primary reference voltage to one of a secondary reference voltage for the stage or an output voltage of the stage, and coupling and configuring the at least one transconductance amplifier to charge and/or discharge an associated capacitor to achieve a desired charge level within a specified time independently of the value of the associated capacitor. In general, the transconductance amplifiers of each stage are configured to charge and/or discharge an associated capacitor in synchronism with a voltage present on the primary reference voltage input.

20 Claims, 7 Drawing Sheets

CONTROLLED POWER UP AND POWER DOWN OF MULTI-STAGE LOW DROP-OUT REGULATORS

BACKGROUND

(1) Technical Field

This invention relates to electronic circuitry, and more particularly to regulator circuits for switched-mode power supplies.

(2) Background

An electronic switched-mode power supply (SMPS) transfers power from a DC or AC source to DC loads, such as a personal computer or cellular phone, while converting voltage and current characteristics. Voltage regulation is achieved by varying the ratio of ON-to-OFF time of a pass transistor rather than by power dissipation, as in linear power supplies, resulting in high power conversion efficiency. Switched-mode power supplies may also be substantially smaller and lighter than a linear power supply, and accordingly are quite useful in portable electronic devices.

The characteristic switching operation of an SMPS means that the output voltage of the SMPS is not flat, but includes a ripple voltage. A ripple voltage is very undesirable when powering noise-sensitive circuitry, such as radio frequency (RF) circuitry. Accordingly, the output of an SMPS is generally regulated to essentially eliminate the ripple voltage.

For example, FIG. 1 is a block diagram of a prior art electronic circuit 100 powered by an SMPS 102. As illustrated, the SMPS 102 outputs a supply voltage 104 that includes a ripple voltage. A low drop-out (LDO) regulator 106 having a sufficiently high Power Supply Rejection Ratio filters out the SMPS output voltage ripples and provides an essentially constant DC power output voltage 108. The "clean" voltage output from the LDO regulator 106 may then be provided to noise-sensitive circuitry 110, which may be, for example, RF circuitry including mixers, low noise amplifiers (LNAs), phase locked loops (PLLs), voltage controlled oscillators (VCOs), etc.

An LDO regulator is a DC linear voltage regulator that can regulate an output voltage even when the supply voltage is very close to the output voltage. LDO regulators avoid switching noise (as no switching takes place), generally have a small device size (as neither large inductors nor transformers are needed), and often have a relatively simple circuit architecture (usually comprising a voltage reference, an amplifier, and a pass transistor).

A trend in the power supply industry has been to increase the switching frequency of SMPSs embodied (at least in part) in integrated circuits (ICs) in order to scale down the size of needed inductors and reduce the die area required for the SMPS. For example, the trend has been to move from a switching frequency of about 100 kHz to about 1 MHz. However, high switching frequencies lead to high frequency output ripple voltage, which must be filtered out when powering noise-sensitive circuitry. Accordingly, an LDO regulator 106 must have a very high Power Supply Rejection Ratio (PSRR), which is a conventional measure of the capability of an LDO regulator 106 to suppress any power supply variations to its output signal.

One way of achieving high PSRR (and thus low noise) in an LDO regulator is to couple two or more LDO stages in a series cascade. Each LDO stage provides moderate isolation from the input power supplied by an SMPS. For example, FIG. 2 is a schematic diagram of a prior art embodiment of a 2-stage LDO regulator 200. Stage 1 of the LDO regulator 200 is a dependent stage that includes a secondary reference voltage source 202, such as a voltage buffer, coupled to a primary reference voltage input 204, such as an on-chip band gap voltage source or an off-chip reference voltage source (e.g., supplied by another chip or stable voltage source via a die pin). The output of the reference voltage source 202, $V_{REF1}$, is applied to a relatively large input decoupling capacitor $C_{REF1}$ and to the control input of a conventional LDO circuit, LDO1. A power input, $V_{IN}$, to LDO1 is the supply voltage 104 of an SMPS (see FIG. 1). A decoupling capacitor $C_{LDO1}$ filters noise from the output, $V_{LDO1}$, of LDO1, supplies instant demand of LDO1 output currents, and provides a charge reservoir for smoothing the output against switching loads.

Stage 2 of the LDO regulator 200 is the output stage of the LDO regulator 200, and includes a conventional LDO circuit, LDO2, having a control input coupled to the primary reference voltage input 204 and to a relatively large input decoupling capacitor $C_{REF2}$. The output, $V_{LDO1}$, of LDO1 from Stage 1 is coupled as the power input to LDO2. A decoupling capacitor $C_{LDO2}$ filters noise from the output, $V_{LDO2}$, of LDO2, supplies instant demand of LDO2 output currents, and provides a charge reservoir for smoothing the output against switching loads. The output, $V_{LDO2}$, of LDO2 is an essentially constant DC power output voltage 108 at a circuit out-put $V_{OUT}$.

The various capacitors shown in FIG. 2 are typically implemented as off-chip components, but in some applications may be on-chip. In some variants, REF1 may be independent of REF2, but care would need to be taken to let Stage 1 power up before Stage 2 in order to provide adequate power to Stage 2.

The overall PSRR of a multi-stage LDO regulator is the sum (in dB) of the PSRR of the individual LDO stages. Thus, for the 2-stage LDO regulator 200 of FIG. 2, $PSRR_{total}$ (dB)=$PSRR_{LDO1}$+$PSRR_{LDO2}$. By cascading LDO stages, each stage need not guarantee a high PSRR by itself, and accordingly its design trade-offs can be relaxed. For example, DC gain per stage can be lower than for a single LDO, which allows for an increase in bandwidth per stage, which is desirable for extending high PSRR to high frequencies (e.g., about 1 MHz).

In high PSRR/low noise LDO regulator designs, it is usually required that the reference voltage inputs for the LDOs be filtered with relatively large input decoupling capacitors, such as $C_{REF1}$ and $C_{REF2}$ in FIG. 2. The presence and size of the input decoupling capacitors results in relatively slow power up and power down times for the reference voltage source, and hence for the multi-stage LDO regulator 200 as a whole. Similarly, the presence and size of the output decoupling capacitors (e.g., $C_{LDO1}$ and $C_{LDO2}$ in FIG. 2, which may be of similar capacitance value as the input decoupling capacitors $C_{REF1}$ and $C_{REF2}$ in FIG. 2), along with a typically poor ability of LDO circuits to sink current at their outputs, results in relatively slow LDO output discharge times for each LDO shown in FIG. 2, and hence for the multi-stage LDO regulator 200 as a whole. (Note that "power down time" and "discharge time" are used interchangeably and to mean any condition in which the output voltage is required to be reduced, thereby requiring charge on the output decoupling capacitors to be sinked to a reference node).

For example, FIG. 3 is a graph 300 showing voltages $V_{REF2}$, $V_{REF1}$, $V_{LDO1}$, and $V_{LDO2}$ as a function of time for an example modeled embodiment of the multi-stage LDO regulator 200 of FIG. 2. When enabled, the primary or "lead" voltage reference $V_{REF2}$ at capacitor $C_{REF2}$ in Stage 2 ramps up sharply (~0.02 sec) from zero volts to a maximum value (~2.4V in this example), which defines a "charge" period starting at dotted line 302. The secondary voltage reference $V_{REF1}$ at capacitor $C_{REF1}$ in Stage 1 is relatively slow (~0.5 sec.) to ramp up from zero volts to a maximum value (~1.3V in this example). As a result, the output voltage at capacitor $V_{LDO1}$ in Stage 1 is relatively slow (~0.65 sec.) to ramp up from zero volts to a maximum value (~2.8V in this example), and the output voltage at capacitor $V_{LDO2}$ in Stage 2 is relatively slow (~0.5 sec.) to ramp up from zero volts to a maximum value (~2.4V in this example).

Similarly, during a "discharge" period starting at dotted line 304, the primary voltage reference $V_{REF2}$ at capacitor $C_{REF2}$ in Stage 2 decays fairly rapidly, but the rates of decay of the voltages $V_{REF1}$, $V_{LDO1}$, and $V_{LDO2}$ are slower and all different from the rate of decay of the primary voltage reference $V_{REF2}$, owing to the varying discharge rates of associated capacitors.

Fast power up and power down times for a multi-stage LDO regulator are desirable in order to meet the needs of downstream powered circuitry, which may be specified by a product developer as expecting power within a set amount of time after the LDO regulator is enabled, and as expecting power to be absent (off) a set amount of time after the LDO regulator is disabled. Accordingly, there is a need for a multi-stage LDO regulator that exhibits fast power up and power down times. The present invention meets this and other needs.

SUMMARY

The present invention encompasses circuits and methods that provide for fast power up and power down times in a multi-stage low drop-out (LDO) regulator.

In one embodiment, a multi-stage LDO regulator circuit includes a primary reference voltage input; a dependent LDO stage including a secondary reference voltage source coupled to the primary reference voltage input, and an associated LDO circuit including (1) a control input coupled to an input capacitor and to the secondary reference voltage source; (2) an output coupled to an output capacitor; (3) a power input configured to be coupled to a voltage source external to the LDO regulator circuit; and (4) an input transconductance amplifier configured to charge and/or discharge the input capacitor to achieve a desired charge level within a specified time independently of the value of the input capacitor; and an output LDO stage coupled to the primary reference voltage input and including an associated LDO circuit including (1) a control input coupled to an input capacitor and to the primary reference voltage input, (2) an output coupled to an output capacitor, and (3) a power input coupled to the output of the dependent LDO stage.

In some embodiments, an output transconductance amplifier is coupled and configured to charge and/or discharge the output capacitor to achieve a desired charge level within a specified time independently of the value of the output capacitor.

In general, the transconductance amplifiers of each stage are configured to charge and/or discharge an associated capacitor in synchronism with a voltage present on the primary reference voltage input.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference numbers and designations in the various drawings indicate like elements.

DETAILED DESCRIPTION

The present invention encompasses circuits and methods that provide for fast power up and power down times in a multi-stage low drop-out (LDO) regulator.

In order to speed up the power up (charging) and power down (discharging) times of a multi-stage LDO regulator, embodiments of the present invention inject an auxiliary current into certain capacitive nodes coupled to the reference voltage sources during power up, and provide an additional sink capability to sink current from those capacitive nodes during power down (discharge). In multi-stage LDO regulators, such embodiments need to be designed with care. For example, the reference voltage sources may be coupled to different capacitor values, or may be coupled to the same capacitor values but have different output impedances, which in either case could lead to very different power up and power down times for the capacitive nodes and thus of the multi-stage LDO regulator as a whole. As another example, a multi-stage LDO regulator tends to be designed as a Class A amplifier, which provides a weak and not well controlled discharge strength for the output voltage side of the regulator. Embodiments of the present invention are therefore designed to adapt the current flowing to or from certain capacitive nodes so as to charge or discharge those nodes within the same time period independently of the capacitor values and independently of the output impedance of the reference voltage sources.

Figure 4:
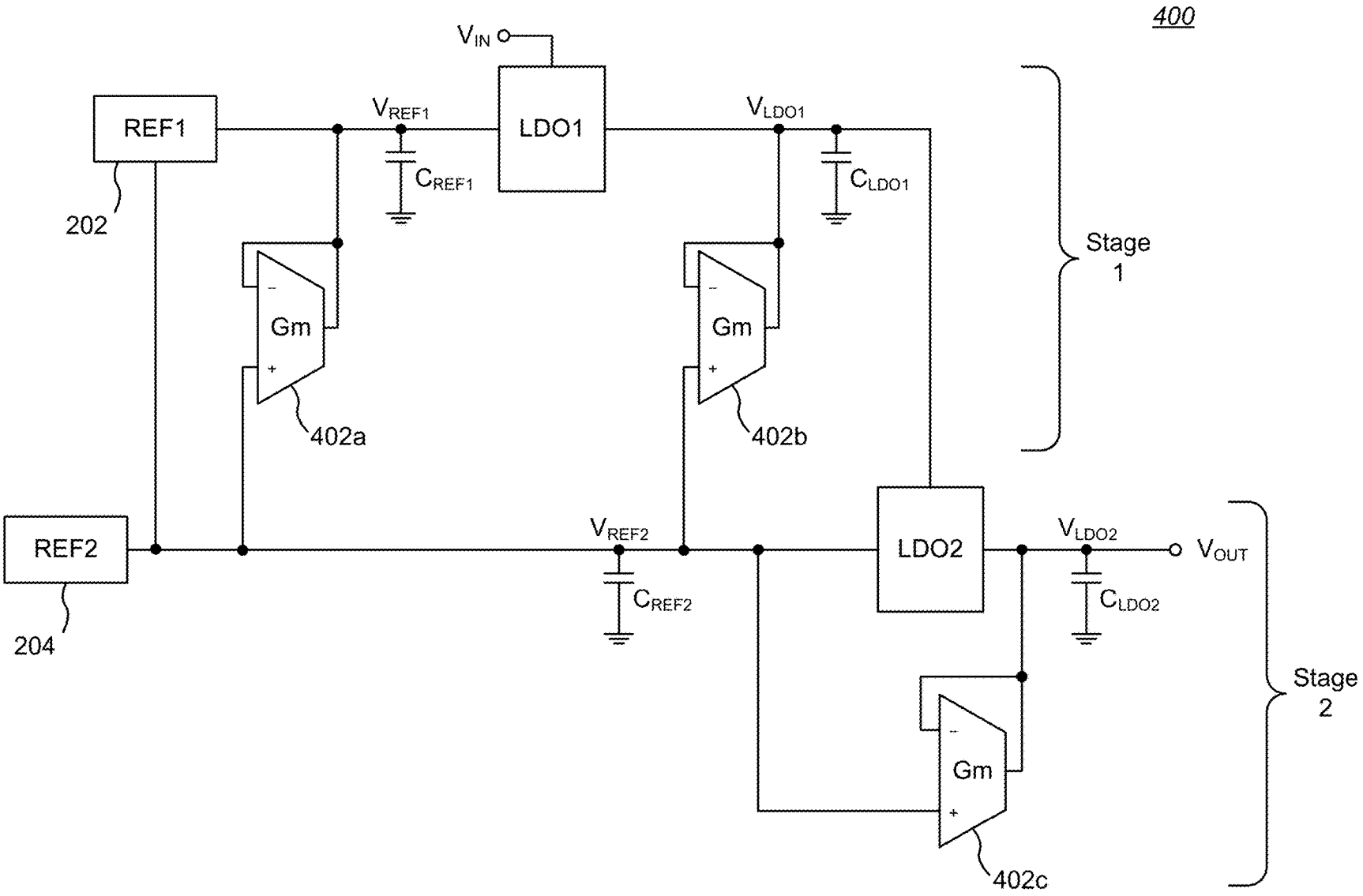
FIG. 4 is a block diagram of a first embodiment of a fast power up/down multi-stage LDO regulator circuit.

FIG. 4 is a block diagram of a first embodiment of a fast power up/down multi-stage LDO regulator circuit 400. The circuit 400 is similar in structure to the 2-stage LDO regulator 200 of FIG. 2, and functions in the same manner after power up and before power down. However, to provide for a fast power up and/or power down capability, a transconductance amplifier (also known as a "Gm amplifer") 402*a*, 402*b*, 402*c*, is coupled to one or more capacitive nodes to be rapidly charged and/or discharged. A Gm amplifier sources or sinks a current proportional to a difference in voltage of its two inputs. In some embodiments, one or both of the inputs to a Gm amplifier may be scaled (e.g., by a resistive divider) to bias the output of the Gm amplifier.

Figure 5A:
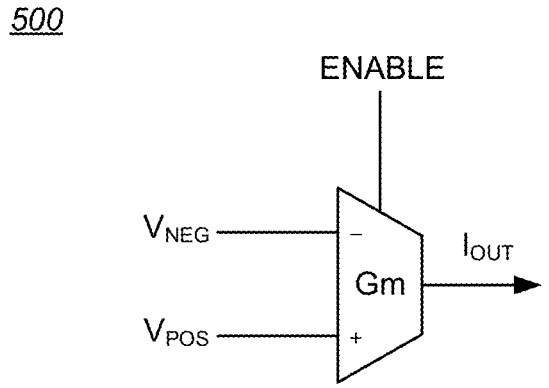
FIG. 5A is a symbolic depiction of a typical Gm amplifier.

FIG. 5A is a symbolic depiction of a typical Gm amplifier 500. A positive input is configured to receive a voltage VpGs, and a negative input is configured to receive a voltage $V_{NEG}$. The output of the Gm amplifier 500 is a current $I_{OUT}$ that is proportional to the difference between $V_{POS}$ and $V_{NEG}$. In some embodiments, the Gm amplifier 500 has an ENABLE input configured to receive a control signal that selectively enables or disables the Gm amplifier 500. As a person of ordinary skill will understand, the Gm amplifiers 402*a*, 402*b*, 402*c* shown in FIG. 4 are typically disabled in normal operation to ensure that their outputs do not compete or conflict with the output of any LDO stage.

Figure 5B:
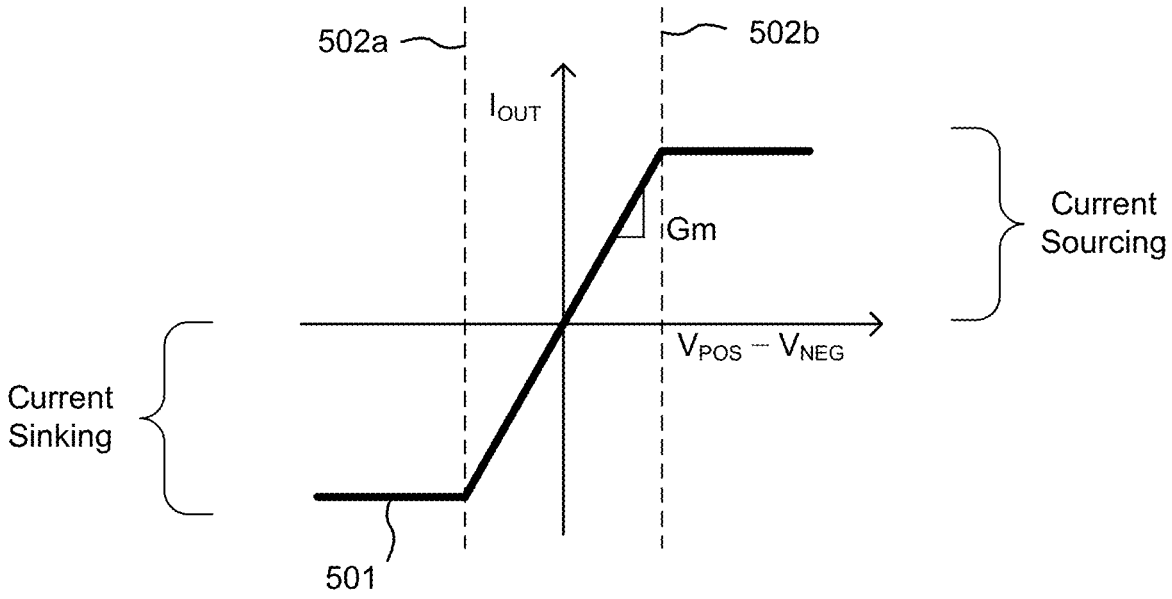
FIG. 5B is a graph showing the output $I_{OUT}$ of the Gm amplifier of FIG. 5A as a function of $V_{POS}$-$V_{NEG}$.

FIG. 5B is a graph showing the output $I_{OUT}$ of the Gm amplifier 500 of FIG. 5A as a function of $V_{POS}$-$V_{NEG}$ (graph line 501). In a range bracketed by the dotted lines 502*a*, 502*b*, $I_{OUT}$ is directly proportional to $V_{POS}$-$V_{NEG}$. The proportionality factor is called the transconductance, Gm, of the device, and is essentially the slope of graph line 501 between the dotted lines 502*a*, 502*b*. As graph line 501 makes clear, a Gm amplifier is able to sink or source current, depending on the polarity of the differential voltage.

In the example illustrated in FIG. 4, a first, input-side Gm amplifier 402*a* has a first input (positive, in this example) coupled to $V_{REF2}$ and a second input (negative, in this example) coupled to $V_{REF1}$. The output of the first Gm amplifier 402*a* is coupled to the conductor that connects the reference voltage source 202 to the decoupling capacitor $C_{REF1}$ and to the control input of LDO1.

When powering up, the first Gm amplifier 402*a* is enabled and any difference in the voltages at the inputs of the Gm amplifier 402*a* will result in generation of a current by the Gm amplifier 402*a* that is added to the current from the reference voltage source 202 to more rapidly charge the decoupling capacitor $C_{REF1}$. More specifically, since $V_{REF2}$ will initially be greater than $V_{REF1}$ during a power up period (since $V_{REF1}$ is derived from $V_{REF2}$), the Gm amplifier 402*a* will proportionally source a current to the decoupling capacitor $C_{REF1}$, thus more rapidly charging that capacitor. Because the output of the Gm amplifier 402*a* is proportional to the difference between its voltage inputs, the source current will dynamically vary as the difference between the two voltages changes over time. Accordingly, as the difference diminishes, the output current also diminishes.

Conversely, because a Gm amplifier can sink current as well as source current, when powering down, any difference in the voltages at the inputs of the Gm amplifier 402*a* will result in the Gm amplifier 402*a* proportionally sinking current from the decoupling capacitor $C_{REF1}$, thus discharging that capacitor more rapidly. More specifically, since $V_{REF2}$ will be less than $V_{REF1}$ during a power down period (since $V_{REF1}$ is held higher than $V_{REF2}$ by the decoupling capacitor $C_{REF1}$), the Gm amplifier 402*a* will sink current from the decoupling capacitor $C_{REF1}$ regardless of the sink capability of the associated reference voltage source 202, thus more rapidly discharging that capacitor. Again, since the output of the Gm amplifier 402*a* is proportional to the difference between its voltage inputs, the current sinking capability will dynamically vary as the difference between the two voltages changes over time. Accordingly, as the difference diminishes, the output current sinking also diminishes.

Thus, in both power up and power down periods, the Gm amplifier 402*a* automatically determines the amount of source or sink current needed to charge or discharge its associated capacitive node independently of the impedance of its associated reference voltage source or the capacitance of its associated decoupling capacitor.

In the illustrated example, a second, output-side Gm amplifier 402*b* has a first input (positive, in this example) coupled to $V_{REF2}$ and a second input (negative, in this example) coupled to $V_{LDO1}$. The output of the Gm amplifier 402*b* is coupled to the conductor that connects the output of LDO1 to the decoupling capacitor $C_{LDO1}$. Accordingly, in response to the difference between $V_{LDO1}$ and $V_{REF2}$, the Gm amplifier 402*b* dynamically supplies a proportional auxiliary source current to charge the decoupling capacitor $C_{LDO1}$ during a power up period, and a proportional auxiliary current sink to discharge the decoupling capacitor $C_{LDO1}$ during a power down period.

Similarly, in the illustrated example, a third Gm amplifier 402*c* has a first input (positive, in this example) coupled to $V_{REF2}$ and a second input (negative, in this example) coupled to $V_{LDO2}$. The output of the Gm amplifier 402*c* is coupled to the conductor that connects the output of LDO2 to the decoupling capacitor $C_{LDO2}$. Accordingly, in response to the difference between $V_{LDO2}$ and $V_{REF2}$, the Gm amplifier 402*c* dynamically supplies a proportional auxiliary source current to charge the decoupling capacitor $C_{LDO2}$ during a power up period, and a proportional auxiliary current sink to discharge the decoupling capacitor $C_{LDO1}$ during a power down period.

A Gm amplifier may be coupled to every node of a multi-stage LDO regulator that needs assistance during power up and/or power down periods to achieve a desired charge level within a specified time. In some embodiments, if the time for powering down is not a critical specification, then Gm amplifiers need not be added to the output side of one or more constituent LDOs. In some embodiments, if the time for powering down is not a critical specification, then the Gm amplifiers on the control input side of one or more constituent LDOs may be replaced by simpler differential voltage amplifiers. In some embodiments, one or more Gm amplifiers generally would be disabled in "normal" operation, when the multi-stage LDO regulator is not powering up or down. However, in some embodiments, one or more Gm amplifiers may be enabled in "normal" operation.

Figure 6:
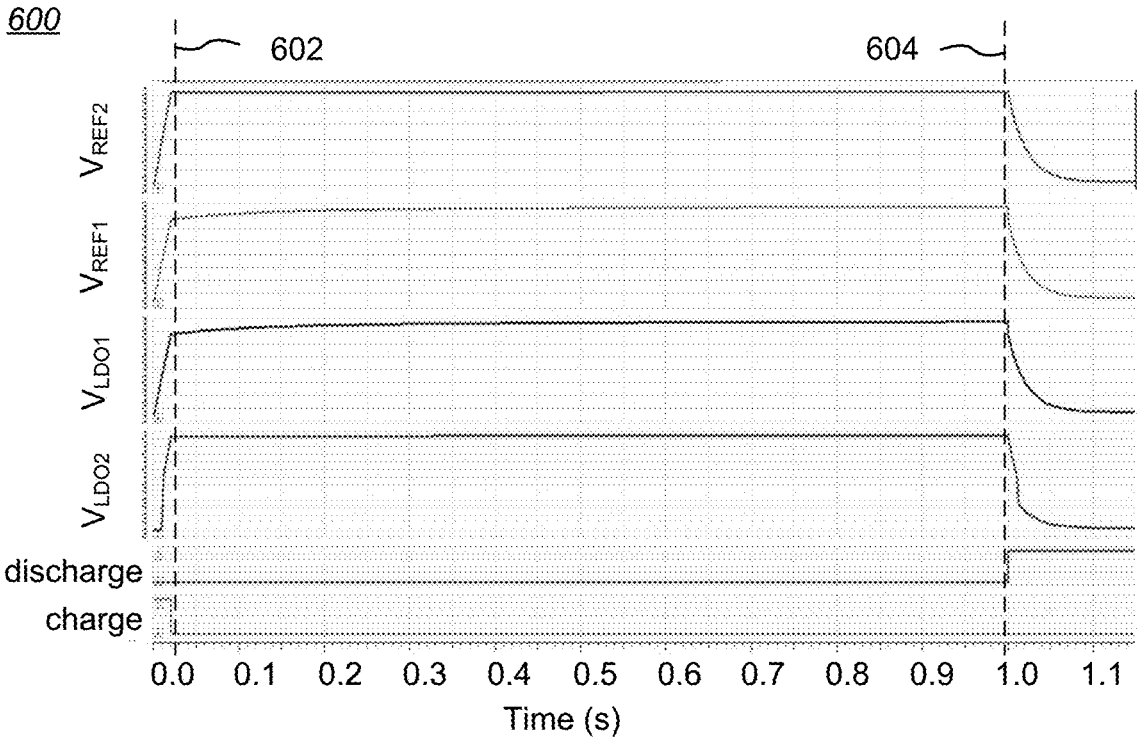
FIG. 6 is a graph showing voltages $V_{REF2}$, $V_{REF1}$, $V_{LDO1}$, and $V_{LDO2}$ as a function of time for an example modeled embodiment of the multi-stage LDO regulator of FIG. 4.

FIG. 6 is a graph 600 showing voltages $V_{REF2}$, $V_{REF1}$, $V_{LDO1}$, and $V_{LDO2}$ as a function of time for an example modeled embodiment of the multi-stage LDO regulator 400 of FIG. 4. When enabled, the primary or "lead" voltage reference $V_{REF2}$ at capacitor $C_{REF2}$ in Stage 2 ramps up sharply (~0.02 sec) from zero volts to a maximum value (~2.4V in this example), which defines a "charge" period starting at dotted line 602. All of the other voltages $V_{REF1}$, $V_{LDO1}$, and $V_{LDO2}$ closely follow the lead voltage reference $V_{REF2}$. Thus, the secondary voltage reference $V_{REF1}$ at capacitor $C_{REF1}$ in Stage 1 ramps up sharply from zero volts to near its maximum value (~1.3V in this example) within less than ~0.03 sec. As a result, the output voltage at capacitor $V_{LDO1}$ in Stage 1 quickly ramps up from zero volts to near its maximum value (~2.8V in this example) in about the same time (less than ~0.03 sec.), and the output voltage at capacitor $V_{LDO2}$ in Stage 2 quickly ramps up from zero volts to near its maximum value (~2.4V in this example) in about the same time (less than ~0.03 sec.).

Figure 2:
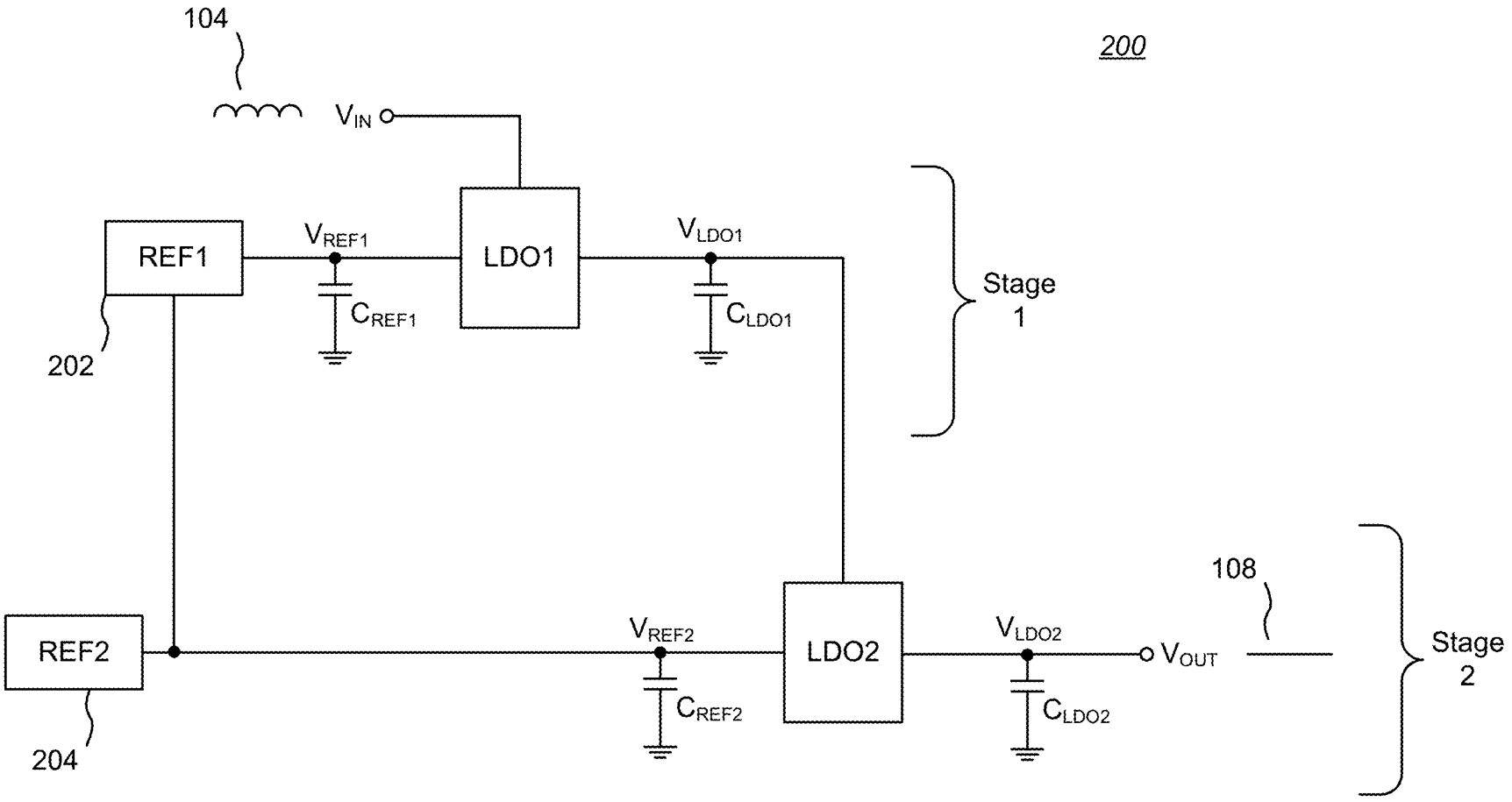
FIG. 2 (Prior Art)
FIG. 2 is a schematic diagram of a prior art embodiment of a 2-stage LDO regulator.
Figure 3:
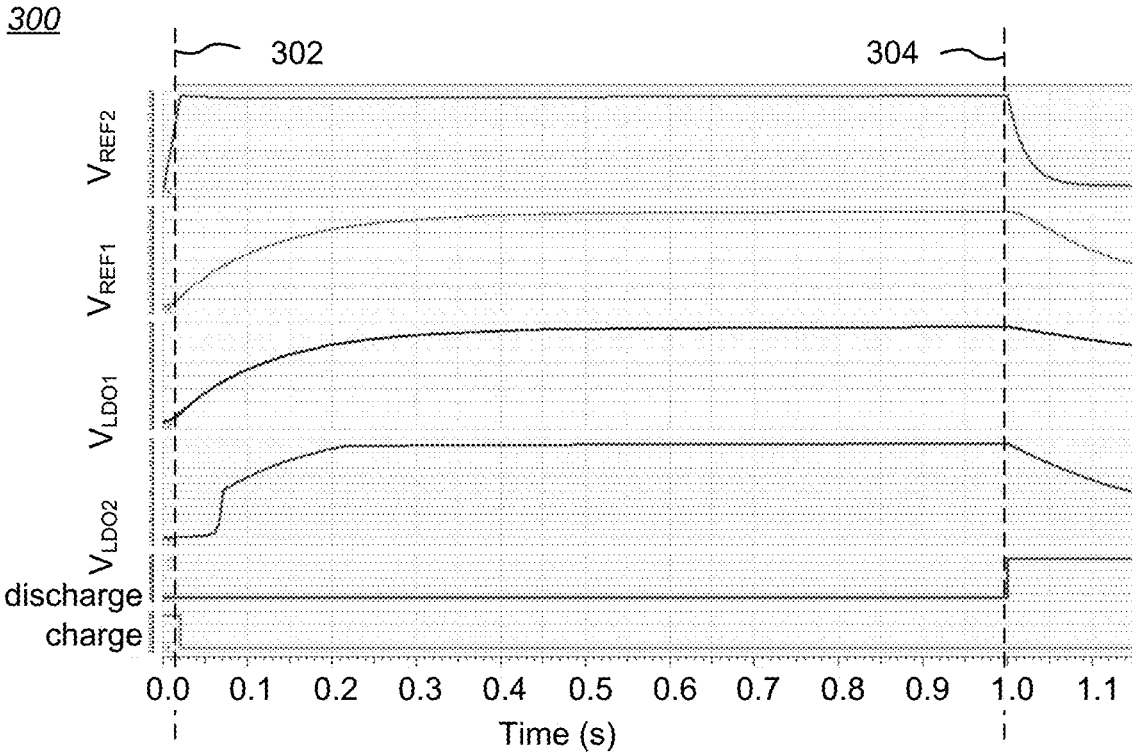
FIG. 3 is a graph showing voltages $V_{REF2}$, $V_{REF1}$, $V_{LDO1}$, and $V_{LDO2}$ as a function of time for an example modeled embodiment of the multi-stage LDO regulator of FIG. 2.

Similarly, during a "discharge" period starting at dotted line 604, the primary voltage reference $V_{REF2}$ at capacitor $C_{REF2}$ in Stage 2 decays much more rapidly than the discharge times shown at dotted line 304 in FIG. 3 for the prior art circuit of FIG. 2, and the rates of decay of the voltages $V_{REF1}$, $V_{LDO1}$, and $V_{LDO2}$ closely fall in synchronism with the primary voltage reference $V_{REF2}$.

In a modeled embodiment of the multi-stage LDO regulator 400 of FIG. 4, the graph lines shown in FIG. 6 were essentially the same over a wide range of capacitor values for the capacitor $C_{REF1}$ (e.g., from about 10 nF to about 10 μF), indicating that the rate of charge and discharge charge of the capacitor $C_{REF1}$ was independent of its capacitive value and essentially solely determined by the sink/source current provided by or through the Gm amplifier 402*a*. Similarly, the graph lines shown in FIG. 6 were essentially the same over a wide range of capacitor values for the capacitors $C_{LDO1}$ and $C_{LDO2}$ (e.g., from about 10 nF to about 10 μF), indicating that the rate of charge and discharge of the capacitors $C_{LDO1}$ and $C_{LDO2}$ was independent of its capacitive value and essentially solely determined by the sink/source current provided by or through the Gm amplifier 402*c*.

Figure 7:
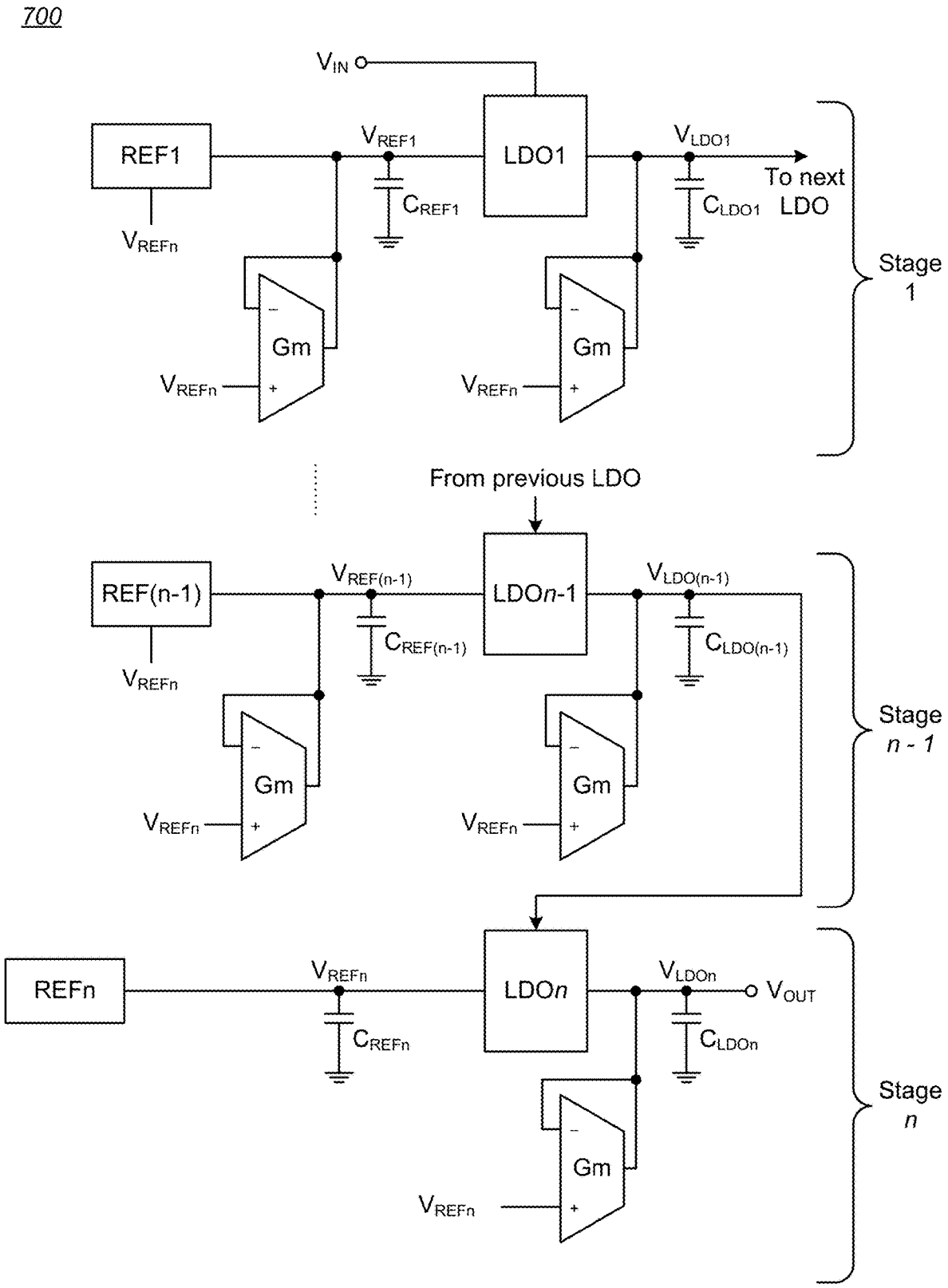
FIG. 7 is a block diagram of a second embodiment of a fast power up/down LDO regulator having n stages, where n≥2.

The use of Gm amplifiers as described above can be extended to multi-stage LDO regulators having more than two stages. For example, FIG. 7 is a block diagram of a second embodiment of a fast power up/down LDO regulator 700 having n stages, where n≥2. Stages 1 to n−1 in FIG. 7 are essentially the same as Stage 1 in FIG. 4, except that only Stage 1 in FIG. 7 is coupled to $V_{IN}$; each intermediate stage 2 through n−1 is powered by a previous LDO stage. The output LDO stage, Stage n, is essentially the same as Stage 2 in FIG. 4 and is powered by stage n−1.

In the example shown in FIG. 7, a Gm amplifier is coupled to every capacitor that needs assistance during power up and/or power down periods to achieve a desired charge level within a specified time. In some alternative embodiments, if the time for powering down is not a critical specification, then Gm amplifiers need not be added to the output side of one or more constituent LDO stages to charge or discharge the corresponding output-side decoupling capacitors $C_{LDOn}$. In some alternative embodiments, if the time for powering down is not a critical specification, then the Gm amplifiers on the control input side of one or more constituent LDO stages may be removed or may be replaced by simpler differential voltage amplifiers.

The use of a Gm amplifier as described above can be beneficially applied to single stage LDO regulators. For example, an LDO regulator comprising only Stage 2 of FIG. 4 may benefit from adding a Gm amplifier 402*c* to the output side in order to improve power down discharge times (i.e., faster discharging of the decoupling capacitor $C_{LDO2}$).

Embodiments of the present invention beneficially utilize the proportional current sourcing and sinking capabilities of Gm amplifiers to charge or discharge certain capacitive nodes of a multi-stage LDO regulator in synchronism with a primary reference voltage source. By using Gm amplifiers to compare relative voltages between the primary reference voltage source and a capacitive node, the power up and power down times of the whole system can be made to be dependent only on the start-up time of the primary reference voltage source, regardless of the capacitor values and independent of the output impedance of any reference voltage source. Furthermore, by synchronizing power up and power down of all devices within a multi-stage LDO regulator by use of Gm amplifiers as described above, the relative voltage relationships of such devices are maintained at all times, thus allowing the use of low voltage devices rather than high voltage devices (needed if the relative voltage relationships of such devices can be excessive).

System Aspects

Figure 1:
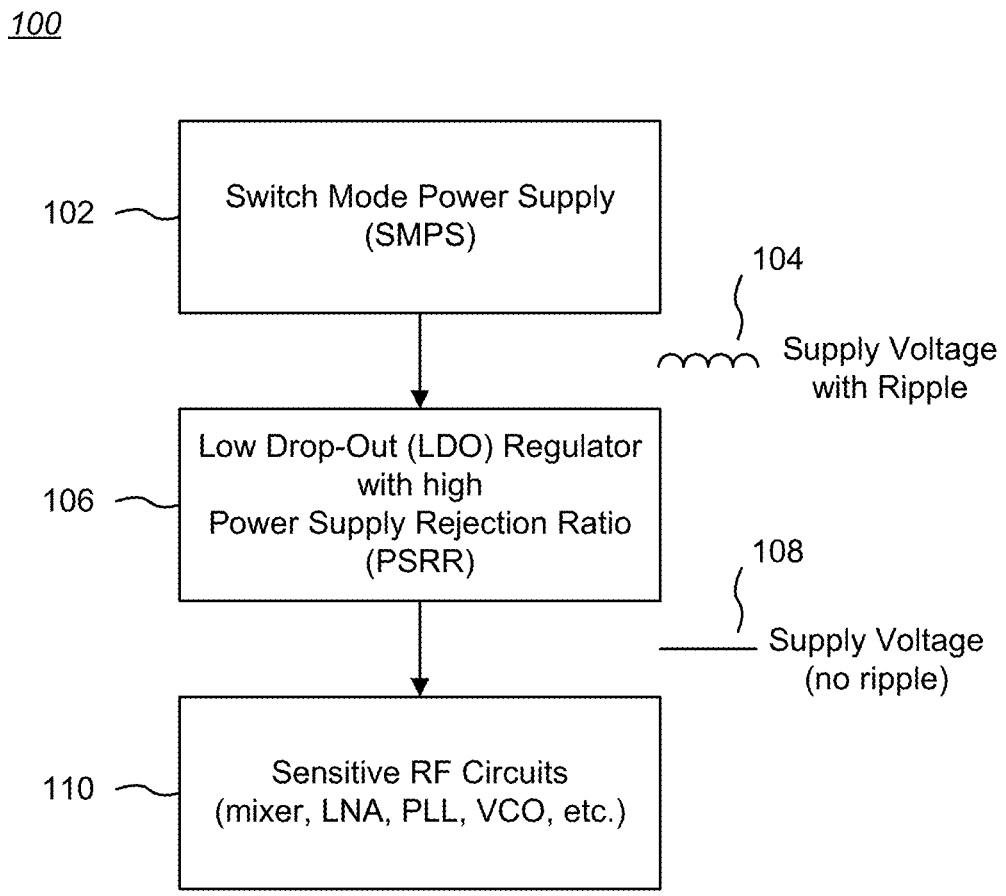
FIG. 1 (Prior Art)
FIG. 1 is a block diagram of a prior art electronic circuit powered by an SMPS.

Referring back to FIG. 1, it should be appreciated that multi-stage LDO regulator circuits in accordance with the present invention provide improved performance for products that include a switched-mode power supply 102 for providing clean power to noise-sensitive circuitry 110, particularly RF circuitry. In particular, because some or all of the input and/or output capacitors of such a multi-stage LDO are actively charged and/or discharged to achieve a desired charge level within a specified time independently of the value of such capacitors (and independently of the output impedance of the reference voltage sources), such a multi-stage LDO regulator circuit provides fast power up and power down times. Accordingly, such a multi-stage LDO regulator better meets the needs of downstream powered circuitry, which may be specified by a product developer as expecting power within a set amount of time after the LDO regulator is enabled, and as expecting power to be absent (off) a set amount of time after the LDO regulator is disabled.

Methods

Figure 8:
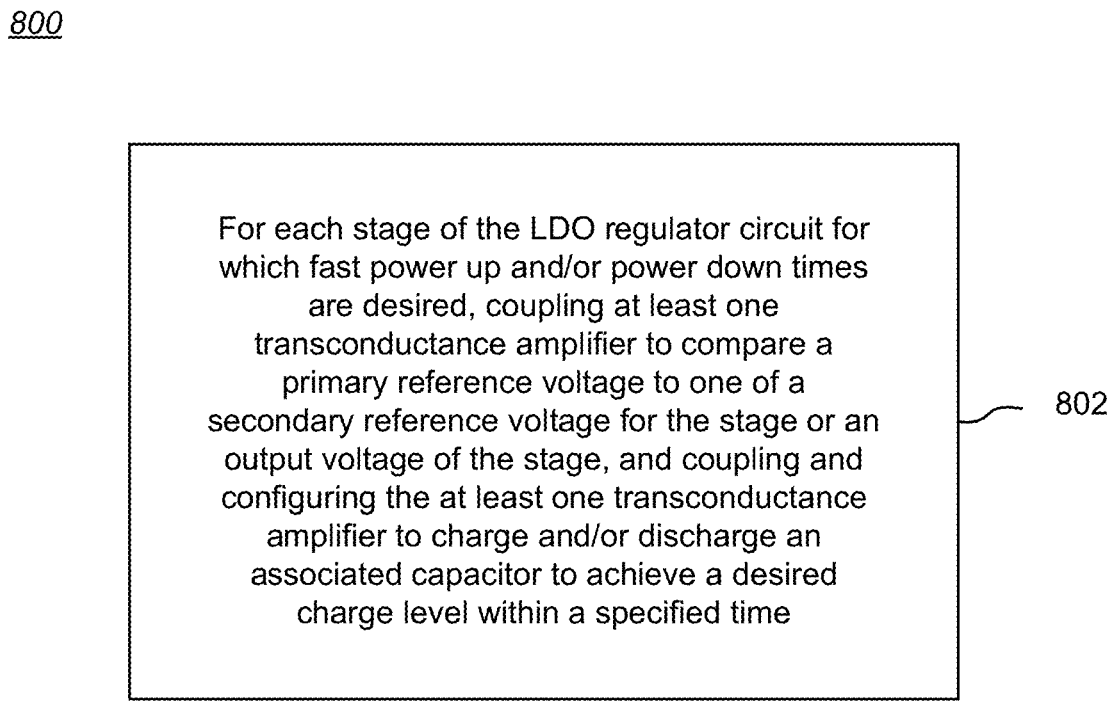
FIG. 8 is a process flow chart showing one method for providing fast power up and/or power down times in a multi-stage LDO regulator circuit.

Another aspect of the invention includes methods for providing fast power up and/or power down times in a multi-stage LDO regulator circuit. For example, FIG. 8 is a process flow chart 800 showing one method for providing fast power up and/or power down times in a multistage LDO regulator circuit. The method includes, for each stage of the LDO regulator circuit for which fast power up and/or power down times are desired, coupling at least one transconductance amplifier to compare a primary reference voltage to one of a secondary reference voltage for the stage or an output voltage of the stage, and coupling and configuring the at least one transconductance amplifier to charge and/or discharge an associated capacitor to achieve a desired charge level within a specified time (which is essentially independent of the value of the associated capacitor) [Block 802].

Additional aspects of the above method may include configuring the at least one transconductance amplifier of each stage to charge and/or discharge the associated capacitor in synchronism with the primary reference voltage.

Fabrication Technologies & Options

The term "MOSFET", as used in this disclosure, includes any field effect transistor (FET) having an insulated gate whose voltage determines the conductivity of the transistor, and encompasses insulated gates having a metal or metal-like, insulator, and/or semiconductor structure. The terms "metal" or "metal-like" include at least one electrically conductive material (such as aluminum, copper, or other metal, or highly doped polysilicon, graphene, or other electrical conductor), "insulator" includes at least one insulating material (such as silicon oxide or other dielectric material), and "semiconductor" includes at least one semiconductor material.

As used in this disclosure, the term "radio frequency" (RF) refers to a rate of oscillation in the range of about 3 kHz to about 300 GHz. This term also includes the frequencies used in wireless communication systems. An RF frequency may be the frequency of an electromagnetic wave or of an alternating voltage or current in a circuit.

Various embodiments of the invention can be implemented to meet a wide variety of specifications. Unless otherwise noted above, selection of suitable component values is a matter of design choice. Various embodiments of the invention may be implemented in any suitable integrated circuit (IC) technology (including but not limited to MOSFET structures), or in hybrid or discrete circuit forms.

Integrated circuit embodiments may be fabricated using any suitable substrates and processes, including but not limited to standard bulk silicon, silicon-on-insulator (SOI), and silicon-on-sapphire (SOS). Unless otherwise noted above, embodiments of the invention may be implemented in other transistor technologies such as bipolar, BiCMOS, LDMOS, BCD, GaAs HBT, GaN HEMT, GaAs pHEMT, and MESFET technologies. However, embodiments of the invention are particularly useful when fabricated using an SOI or SOS based process, or when fabricated with processes having similar characteristics. Fabrication in CMOS using SOI or SOS processes enables circuits with low power consumption, the ability to withstand high power signals during operation due to FET stacking, good linearity, and high frequency operation (i.e., radio frequencies up to and exceeding 50 GHz). Monolithic IC implementation is particularly useful since parasitic capacitances generally can be kept low (or at a minimum, kept uniform across all units, permitting them to be compensated) by careful design.

Voltage levels may be adjusted, and/or voltage and/or logic signal polarities reversed, depending on a particular specification and/or implementing technology (e.g., NMOS, PMOS, or CMOS, and enhancement mode or depletion mode transistor devices). Component voltage, current, and power handling capabilities may be adapted as needed, for example, by adjusting device sizes, serially "stacking" components (particularly FETs) to withstand greater voltages, and/or using multiple components in parallel to handle greater currents. Additional circuit components may be added to enhance the capabilities of the disclosed circuits and/or to provide additional functionality without significantly altering the functionality of the disclosed circuits.

Circuits and devices in accordance with the present invention may be used alone or in combination with other components, circuits, and devices. Embodiments of the present invention may be fabricated as integrated circuits (ICs), which may be encased in IC packages and/or in modules for ease of handling, manufacture, and/or improved performance. In particular, IC embodiments of this invention are often used in modules in which one or more of such ICs are combined with other circuit blocks (e.g., filters, amplifiers, passive components, and possibly additional ICs) into one package. The ICs and/or modules are then typically combined with other components, often on a printed circuit board, to form an end product such as a cellular telephone, laptop computer, or electronic tablet, or to form a higher level module which may be used in a wide variety of products, such as vehicles, test equipment, medical devices, etc. Through various configurations of modules and assemblies, such ICs typically enable a mode of communication, often wireless communication.

Conclusion

A number of embodiments of the invention have been described. It is to be understood that various modifications may be made without departing from the spirit and scope of the invention. For example, some of the steps described above may be order independent, and thus can be performed in an order different from that described. Further, some of the steps described above may be optional. Various activities described with respect to the methods identified above can be executed in repetitive, serial, and/or parallel fashion.

It is to be understood that the foregoing description is intended to illustrate and not to limit the scope of the invention, which is defined by the scope of the following claims, and that other embodiments are within the scope of the claims. In particular, the scope of the invention includes any and all feasible combinations of one or more of the processes, machines, manufactures, or compositions of matter set forth in the claims below. (Note that the parenthetical labels for claim elements are for ease of referring to such elements, and do not in themselves indicate a particular required ordering or enumeration of elements; further, such labels may be reused in dependent claims as references to additional elements without being regarded as starting a conflicting labeling sequence).

What is claimed is:

1. A low dropout (LDO) regulator circuit having n stages, where n≥2, the LDO regulator circuit including:

(a) a primary reference voltage input;

(b) n−1 series-coupled dependent LDO stages each including an associated secondary reference voltage source coupled to the primary reference voltage input, and an associated LDO circuit including:

(1) a control input coupled to an input capacitor and to the associated secondary reference voltage source;

(2) an output coupled to an output capacitor;

(3) a power input coupled to one of the output of a previous n−1 series-coupled dependent LDO stage or configured to be coupled to a voltage source external to the LDO regulator circuit; and (4) a transconductance amplifier having a first voltage input coupled to the primary reference voltage input, a second voltage input coupled to the associated secondary reference voltage source, and a current output coupled to the input capacitor, the transconductance amplifier configured to charge and/or discharge the input capacitor to a desired charge level; and (c) an nth output LDO stage coupled to the primary reference voltage input and including an associated LDO circuit including (1) a control input coupled to an input capacitor and to the primary reference voltage input, (2) an output coupled to an output capacitor, and (3) a power input coupled to the output of one of the n−1 series-coupled dependent LDO stages.

2. The invention of claim 1, wherein, for each stage, a charge and/or discharge time for the input capacitor is essentially independent of the value of the input capacitor.

3. The invention of claim 1, wherein the transconductance amplifier of each stage is configured to charge the input capacitor in synchronism with a voltage present on the primary reference voltage input.

4. The invention of claim 1, further including, for each stage, an output transconductance amplifier having a first voltage input coupled to the primary reference voltage input, a second voltage input coupled to the output of the stage, and a current output coupled to the output capacitor of the stage, the output transconductance amplifier configured to charge and/or discharge the output capacitor to a desired charge level.

5. The invention of claim 4, wherein, for each stage, a charge and/or discharge time for each output capacitor is essentially independent of the value of the output capacitor.

6. The invention of claim 4, wherein, for each stage, each output transconductance amplifier is configured to charge and/or discharge the output capacitor in synchronism with a voltage present on the primary reference voltage input.

7. A low dropout (LDO) regulator circuit including:

(a) a primary reference voltage input;

(b) a dependent LDO stage including a secondary reference voltage source coupled to the primary reference voltage input, and an associated LDO circuit including:

(1) a control input coupled to an input capacitor and to the secondary reference voltage source;

(2) an output coupled to an output capacitor;

(3) a power input configured to be coupled to a voltage source external to the LDO regulator circuit; and (4) an input transconductance amplifier having a first voltage input coupled to the primary reference voltage input, a second voltage input coupled to the secondary reference voltage source, and a current output coupled to the input capacitor, the input transconductance amplifier configured to charge and/or discharge the input capacitor to a desired charge level; and (c) an output LDO stage coupled to the primary reference voltage input and including an associated LDO circuit including (1) a control input coupled to an input capacitor and to the primary reference voltage input, (2) an output coupled to an output capacitor, and (3) a power input coupled to the output of the dependent LDO stage.

8. The invention of claim 7, wherein a charge and/or discharge time for the input capacitor is essentially independently of the value of the input capacitor.

9. The invention of claim 7, wherein the input transconductance amplifier of each stage is configured to charge and/or discharge the input capacitor in synchronism with a voltage present on the primary reference voltage input.

10. The invention of claim 7, further including, for each stage, an output transconductance amplifier having a first voltage input coupled to the primary reference voltage input, a second voltage input coupled to the output of the stage, and a current output coupled to the output capacitor of the stage, the output transconductance amplifier configured to charge and/or discharge the output capacitor to a desired charge level.

11. The invention of claim 10, wherein a charge and/or discharge time for the output capacitor is essentially independent of the value of the output capacitor.

12. The invention of claim 10, wherein the input transconductance amplifier of each stage is configured to charge and/or discharge the input capacitor in synchronism with a voltage present on the primary reference voltage input.

13. The invention of claim 10, wherein the output transconductance amplifier of each stage is configured to charge and/or discharge the output capacitor in synchronism with a voltage present on the primary reference voltage input.

14. The invention of claim 10, wherein the input transconductance amplifier of each stage is configured to charge and/or discharge the input capacitor in synchronism with a voltage present on the primary reference voltage input, and wherein the output transconductance amplifier of each stage is configured to charge and/or discharge the output capacitor in synchronism with the voltage present on the primary reference voltage input.

15. A low dropout (LDO) regulator circuit having a single-stage, the LDO regulator circuit including:

(a) a primary reference voltage input;

(b) an output LDO stage coupled to the primary reference voltage input and including an associated LDO circuit including:

(1) a control input coupled to an input capacitor and to the primary reference voltage input;

(2) an output coupled to an output capacitor; and (3) a power input coupled to one of the output of a previous dependent LDO stage or configured to be coupled to a voltage source external to the LDO regulator circuit; and (c) an output transconductance amplifier having a first voltage input coupled to the primary reference voltage input, a second voltage input coupled to the output of the output LDO stage, and a current output coupled to the output capacitor of the output LDO stage, the output transconductance amplifier configured to charge and/or discharge the output capacitor to a desired charge level.

16. The invention of claim 15, wherein a charge and/or discharge time for the output capacitor is essentially independent of the value of the output capacitor.

17. The invention of claim 15, wherein the output transconductance amplifier is configured to charge and/or discharge the output capacitor in synchronism with a voltage present on the primary reference voltage input.

18. A method for providing fast power up and/or power down times in a multi-stage low dropout (LDO) regulator circuit, the method including, for each stage of the LDO regulator circuit for which fast power up and/or power down times are desired, coupling at least one transconductance amplifier to compare a primary reference voltage to one of a secondary reference voltage for the stage or an output voltage of the stage, and coupling and configuring the at least one transconductance amplifier to charge and/or discharge an associated capacitor to a desired charge level.

19. The method of claim 18, wherein a charge and/or discharge time for each capacitor is essentially independent of the value of the capacitor.

20. The method of claim 18, further including configuring the at least one transconductance amplifier of each stage to charge and/or discharge the associated capacitor in synchronism with the primary reference voltage.

* * * * *